US007052392B2

(12) United States Patent
Tessmer et al.

(10) Patent No.: US 7,052,392 B2
(45) Date of Patent: May 30, 2006

(54) METHOD AND APPARATUS FOR PROVIDING AN ADVANTAGE TO A PLAYER IN A BONUS GAME

(75) Inventors: Michael T. Tessmer, Bozeman, MT (US); Lee E. Cannon, Bozeman, MT (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/039,228

(22) Filed: Dec. 31, 2001

(65) Prior Publication Data

US 2003/0125103 A1 Jul. 3, 2003

(51) Int. Cl.
*A63F 9/22* (2006.01)

(52) U.S. Cl. ..... 463/16

(58) Field of Classification Search ..... 463/16, 463/17, 18, 19, 20, 2, 3, 23
See application file for complete search history.

(56) References Cited

U.S. PATENT DOCUMENTS

| | | | | |
|---|---|---|---|---|
| 4,015,846 | A * | 4/1977 | Runte et al. | 463/3 |
| 4,582,324 | A | 4/1986 | Koza et al. | |
| 4,738,451 | A | 4/1988 | Logg | |
| 4,805,907 | A | 2/1989 | Hagiwara | |
| 4,837,728 | A | 6/1989 | Barrie et al. | |
| 4,856,787 | A | 8/1989 | Itkis | |
| 4,926,327 | A | 5/1990 | Sidley | |
| 5,159,549 | A | 10/1992 | Hallman, Jr. et al. | |
| 5,242,163 | A | 9/1993 | Fulton | |
| 5,265,874 | A | 11/1993 | Dickinson et al. | |
| 5,333,868 | A | 8/1994 | Goldfarb | |
| 5,342,049 | A | 8/1994 | Wichinsky et al. | |
| 5,351,970 | A | 10/1994 | Fioretti | |
| 5,411,271 | A | 5/1995 | Mirando | |
| 5,431,408 | A | 7/1995 | Adams | |
| 5,580,308 | A | 12/1996 | Nakamura | |
| 5,655,961 | A | 8/1997 | Acres et al. | |
| 5,720,663 | A | 2/1998 | Nakatani et al. | |
| 5,769,716 | A | 6/1998 | Saffari et al. | |
| 5,779,549 | A | 7/1998 | Walker et al. | |
| 5,803,451 | A | 9/1998 | Kelly et al. | |
| 5,806,045 | A | 9/1998 | Biorge et al. | |
| 5,820,460 | A | 10/1998 | Fulton | |
| 5,833,536 | A | 11/1998 | Davids et al. | |

(Continued)

FOREIGN PATENT DOCUMENTS

| | | |
|---|---|---|
| AU | 718243 | 4/2000 |

(Continued)

OTHER PUBLICATIONS

NBA Jam Extreme review by Games Domain [www.gamesdomain.com/gdreview/zones/reviews/pc/apr97/nba.html] (USA—Dec. 1996).

(Continued)

*Primary Examiner*—Corbett Coburn
(74) *Attorney, Agent, or Firm*—Marshall, Gerstein & Borun LLP

(57) ABSTRACT

A video game allows a player to improve odds of success in a bonus game by winning an advantage outcome in association with play of a primary or base game. An exemplary bonus game is the game of Pong where the player can use advantage credits won in play of the primary or base game to provide himself with an advantage such as lengthening his paddle, shortening his opponent's paddle, or slowing the shrinkage rate of his paddle during the course of the bonus game. Alternatively, he may also purchase one or more advantages for use in the bonus game through monetary payment.

26 Claims, 9 Drawing Sheets

U.S. PATENT DOCUMENTS 5,851,148 A 12/1998 Brune et al.
5,855,515 A 1/1999 Pease et al.
5,902,983 A 5/1999 Crevelt et al.
5,911,418 A 6/1999 Adams
5,935,002 A * 8/1999 Falciglia ..... 463/19
5,947,820 A 9/1999 Morro et al.
5,951,397 A 9/1999 Dickinson
5,971,849 A 10/1999 Falciglia
6,007,426 A 12/1999 Kelly et al.
6,015,346 A 1/2000 Bennett
6,024,643 A 2/2000 Begis
6,039,648 A 3/2000 Guinn et al.
6,048,269 A 4/2000 Burns et al.
6,050,895 A 4/2000 Luciano, Jr. et al.
6,120,031 A 9/2000 Adams
6,142,872 A 11/2000 Walker et al.
6,149,156 A 11/2000 Feola
6,162,122 A 12/2000 Acres et al.
6,165,071 A 12/2000 Weiss
6,173,955 B1 1/2001 Perrie et al.
6,174,235 B1 1/2001 Walker et al.
6,179,711 B1 1/2001 Yoseloff
6,190,255 B1 2/2001 Thomas et al.
6,193,606 B1 2/2001 Walker et al.
6,193,607 B1 2/2001 Kay
6,203,429 B1 3/2001 Demar et al.
6,210,275 B1 4/2001 Olsen
6,227,969 B1 5/2001 Yoseloff
6,234,897 B1 5/2001 Frohm et al.
6,261,177 B1 7/2001 Bennett
6,267,669 B1 7/2001 Luciano, Jr. et al.
6,270,411 B1 8/2001 Gura et al.
6,273,820 B1 8/2001 Haste, III
6,287,197 B1 9/2001 Dickinson et al.
6,302,790 B1 10/2001 Brossard
6,315,660 B1 * 11/2001 DeMar et al. ..... 463/16
6,315,664 B1 11/2001 Baerlocher et al.
6,346,043 B1 2/2002 Colin et al.
6,364,765 B1 4/2002 Walker et al.
6,386,974 B1 5/2002 Adams
6,406,369 B1 6/2002 Baerlocher et al.
6,514,144 B1 2/2003 Riendeau et al.
6,572,471 B1 6/2003 Bennett
6,582,303 B1 6/2003 Weiss
6,605,001 B1 8/2003 Tarantino
6,612,575 B1 9/2003 Cole et al.
6,620,045 B1 9/2003 Berman et al.
6,669,559 B1 12/2003 Baerlocher et al.
6,746,328 B1 6/2004 Cannon et al.
2003/0022711 A1 1/2003 Locke et al.
2003/0027619 A1 * 2/2003 Nicastro, Sr. ..... 463/16
2003/0036418 A1 2/2003 Seelig et al.
2003/0064779 A1 4/2003 Suda
2003/0071417 A1 4/2003 Webb
2003/0104854 A1 6/2003 Cannon
2003/0104860 A1 6/2003 Cannon et al.
2003/0114218 A1 6/2003 McClintic
2003/0114219 A1 6/2003 McClintic
2003/0114220 A1 6/2003 McClintic
2003/0119573 A1 6/2003 McClintic
2003/0119576 A1 6/2003 McClintic et al.
2003/0119580 A1 6/2003 McClintic et al.
2003/0119581 A1 6/2003 Cannon et al.
2003/0125100 A1 7/2003 Cannon
2003/0125107 A1 7/2003 Cannon

FOREIGN PATENT DOCUMENTS

EP 0 896 308 2/1999
EP 1 008 968 6/2000
EP 1 253 563 10/2002
GB 2 062 922 5/1981
GB 2 072 395 9/1981
GB 2 092 796 8/1982
GB 2 197 974 6/1988
GB 2 226 436 6/1990
GB 2 229 565 9/1990
GB 2 262 642 6/1993
GB 2 320 206 6/1998
WO WO 98/51384 11/1998
WO WO 01/19476 3/2001
WO WO 01/33478 5/2001

OTHER PUBLICATIONS

"Who Wants to be a Millionaire?" (RTM) Quiz machine. [www.blazej.demon.co.uk/tplc/yourown.html] (UK—Jan. 2000).

* cited by examiner

METHOD AND APPARATUS FOR PROVIDING AN ADVANTAGE TO A PLAYER IN A BONUS GAME

FIELD OF THE INVENTION

The present invention generally relates to methods and apparatus for gaming and, more specifically, to a method and apparatus for gaming that provides an advantage to a player for use in a bonus game.

BACKGROUND OF THE INVENTION

Gaming machines have long been a significant facet of the gaming industry. The most basic implementation is a mechanical device of laterally adjacent spinning reels, each bearing a number of symbols around its circumference. The player wagers an amount and invokes the reels to spin. The reels stop on random positions so that symbols on the laterally adjacent reels become aligned on a "pay line." If predetermined symbols align on a pay line when the reels stop, then the player is awarded an amount that is inversely related to the probability of the occurrence of the symbols and defined according to a predetermined pay table. Video versions of game machines are now very popular.

A recent development in gaming is the addition of the element of skill into a game. Skills consist of a wide variety of areas such as strength, coordination, and endurance as well as a variety of mental attributes. One of the objectives of gaming regulation is to ensure that the playing of a gaming device is fair to all players regardless of any special physical or mental skills of the player. To that end, emphasis has been on the use of a random number generation technique to provide the "level playing field" for each player. To a large extent this has been a very successful approach to gaming. At first, the random feature was implemented via mechanical means. The shortcomings of this approach were cured with the advent of computer-based gaming devices. In these devices a random game result could be affected by use of a software program that would insure a consistently random result that was statistically sound. This approach also allowed for an independent verification of the device, which also assisted in achieving the goal of fairness by further limiting the opportunity to cheat the device.

The next logical step included the addition of a subset of mental skills in card games such as video poker. In these games the player has choices similar to those in a real card game. The game can be implemented to ensure that the minimum payout requirement of a jurisdiction can be achieved for an unskilled game player, while a skilled player may, on some occasions and for limited periods of time, achieve payout levels that exceeds 100%. These types of games have proved to be very popular with players to the point that they are among the largest numbers of game types in American casinos.

Gaming establishments are continually searching for new games and gaming systems to keep the interest of players. Gaming establishments are concerned that if players lose interest in a game, the gaming machine will sit idle and not contribute to the revenue of the casino. By developing new games, the gaming establishments hope to pique existing players' interests in continued wagering and to attract new players. In addition, players may tend to be more active and consistent in playing the gaming machines that have new games, thus enhancing the potential profit of the gaming machine.

To keep and increase players' interest in gaming, the gaming industry has added "bonus games" to many of its games, including reel and electronic slot machines. A bonus game is a secondary game that is typically activated when the player achieves a specific outcome in a primary game. For instance, the bonus game may be activated when the player receives a winning hand (in the case of a card game) or a specified combination of symbols (in the case of a reel-type game) as an outcome of the primary game being played. Bonus games appeal to players because the probability of winning combinations after entry into the bonus game is, at least, greatly enhanced and, in most instances, some sort of winning outcome is guaranteed.

The bonus game is typically a different type of game than the primary game. This provides more excitement and variety for the player and helps to keep the player at the gaming machine for a longer period of time. However, the bonus game may also be the same type of game as the primary game, except that the bonus game has an increased potential for winning in comparison to the primary game.

In many cases, the bonus game is a singular event in that the play changes to the bonus game when the specific outcome is achieved in the primary game. The bonus game is then played to completion. Examples of this type of bonus game are disclosed in U.S. Pat. Nos. 5,823,874, 5,848,932, 5,882,261 and 6,089,978, all to Adams. Various embodiments as disclosed in the aforementioned patents include methods of playing games employing gaming machines as well as table games for play of primary games and at least one payout indicator for a secondary or bonus game. The bonus game is independent of the primary game but is enabled by selected outcomes of the primary game. One embodiment operates such that when the reels of the primary game produce a preselected outcome, the bonus game is enabled. In the bonus game, the player initiates the spin of a wheel or reel bearing a number of payout values, or initiates another bonus event such as a bowling-type or pinball-type payout indicator. When the bonus event is completed, the amount of the bonus payout is indicated.

Another example of a bonus game is described in U.S. Pat. No. 6,089,976 to Schneider et al. In this design, the bonus game displays a multiplicity of images on a video monitor from which the player selects until achieving a pair of matched bonus awards.

In some cases, the bonus game is a more sequential event in that progressing through the bonus game is determined by continued play in the primary game. An example of this is described in U.S. Pat. No. 5,980,384 to Barrie. In that design, the player can win the primary game on each play of the game, and the bonus game can be won over a plurality of plays of the primary game.

The bonus game may be conducted through a plurality of networked games such that the bonus game might involve a plurality of individuals who have been wagering at the primary games. Some examples of bonus gaming include U.S. Pat. No. 5,779,544, U.S. Pat. No. 5,664,998 and U.S. Pat. No. 5,560,603, all to Seelig et al. More particularly, some examples of bonus gaming including a plurality of networked primary gaming machines include U.S. Pat. No. 6,146,273 to Olsen, U.S. Pat. No. 6,012,982 to Piechowiak et al., and U.S. Pat. No. 5,876,284 to Acres et al.

While the above-mentioned bonus games have been used in the gaming industry, improved gaming systems and methods are still needed to pique and maintain players' interests in gaming. Preferably, these improved gaming systems and methods would appeal to the player's competitive nature, introduce novel games of chance, and provide the potential for larger payoffs in comparison to the payoffs in the primary game and in other bonus games. These improved gaming systems and methods would offer a bonus game in which the players compete against one another or against a computer-generated opponent. Such a bonus game would increase the players' level of excitement because it would place the players in a more competitive setting than during play of a noncompetitive, conventional bonus game.

There have been some recent attempts to bring a skill level into a slot machine type of game. One example is the Ripley's Believe It or Not® slot machine game by Mikohn Gaming Corporation. This game has a bonus feature that allows the player to select answers to questions. The player is provided a series of questions and four possible answers for each question. If he answers a question correctly on the first try, he is awarded a specified bonus amount. If the player answers it incorrectly on the first try and correctly on the second try, he is awarded a lower specified bonus amount. This continues until his fourth try, at which point the player is awarded the minimum specified bonus amount. He then proceeds to answer the next and subsequent questions in a similar manner. At the end of the session, the player's total credits are added up and if they exceed a certain minimum level, he can proceed to the next level of questions.

It would be advantageous to provide a player with an enhanced playing experience in competitive gaming by using strategy and using an advantage won in association with play of a primary or base game in a later bonus game.

BRIEF SUMMARY OF THE INVENTION

A video-type gaming machine enables a player to improve the odds of success in a bonus game by winning an "advantage" outcome in a primary or base game. One example is a Pong-type bonus game where the player can win advantage credits in association with play of the primary or base game which may later be used to advantage to lengthen his paddle, shorten his opponent's paddle, or slow the shrinkage rate of his paddle during the course of a bonus game. Other competitive game formats wherein advantages may be obtained, including without limitation game formats relating to basketball, hockey, horse racing, ski racing and auto racing as well as game formats where one competes against a standard rather than a competitor, such as rodeo or rock climbing, are also encompassed by the present invention.

It is contemplated that the advantage credits may be used for play of a bonus game triggered during a session of play in which the advantage credits are earned or, with an appropriately configured gaming system using player tracking technology, used in a later bonus game during one or more subsequent gaming sessions. It is also contemplated that a player may also purchase one or more advantages for use in a bonus event through monetary payment, either in association with play of a primary or base game or as a specific sum tendered during bonus game play.

The bonus game may be configured for competitive match play between two opponents, for competition between a plurality of players, or for play in the form of a solo player trying to achieve some goal or objective. In each instance, advantage credits may be used to purchase an advantage for the player using them or, in some instances, a disadvantage for one or more opponents.

The bonus game may be configured so that the advantage credits may be electively employed, that is to say at the player's option, or the advantage or advantages earned may be automatically employed in the next bonus game in which the player participates.

As used herein, the terms "game," "gaming" and "game of chance" include and encompass not only games having a random or arbitrary outcome, but also such games which also invite or require some player input to the game having at least a potential for affecting a game outcome. Such player input is generally termed "skill" whether or not such input is in actuality beneficial in terms of game outcome.

The term "he" or "his" may be employed herein for convenience in conjunction with gaming activities and includes and encompasses either gender.

DETAILED DESCRIPTION OF THE INVENTION

Figure 1:
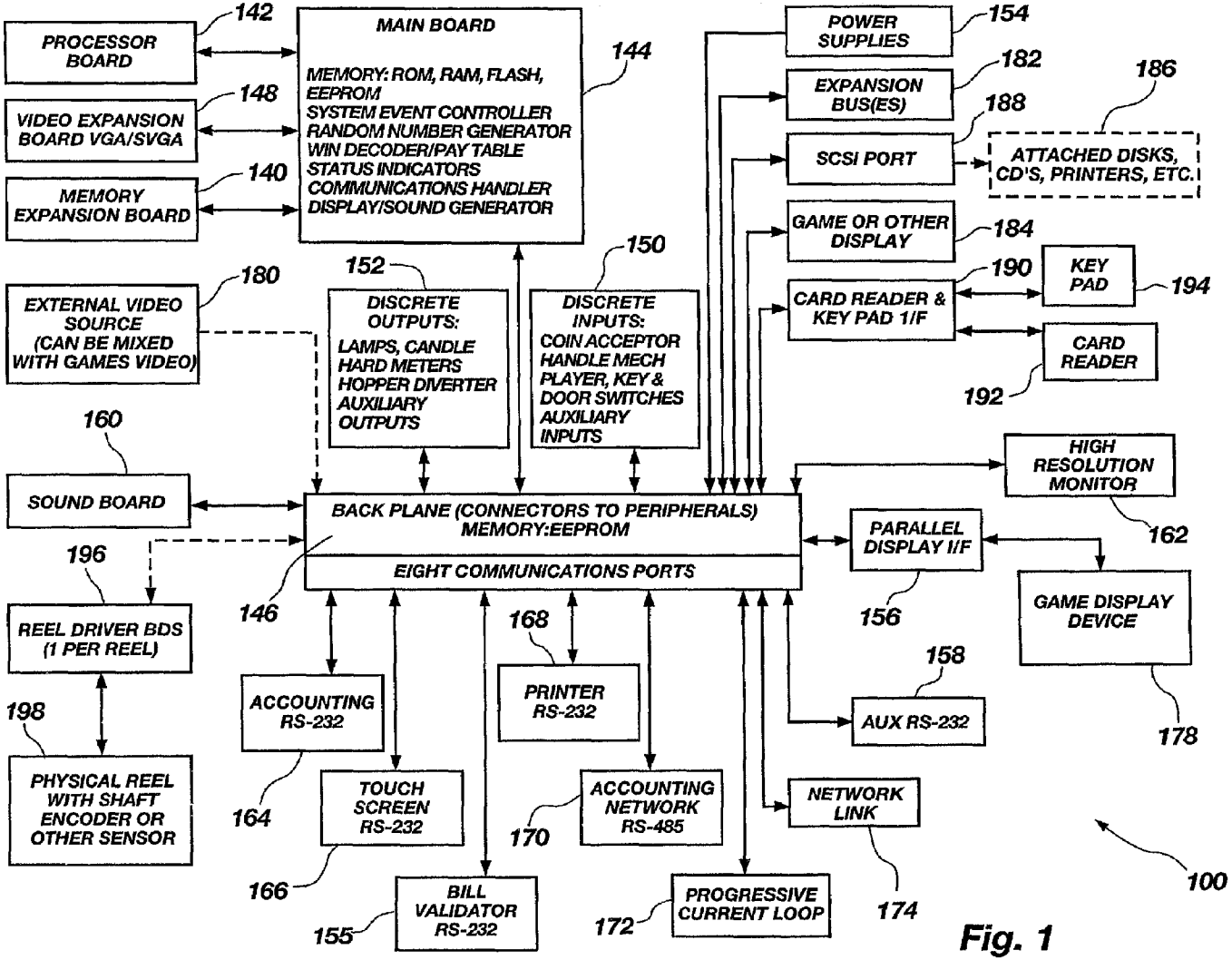
FIG. 1 is a block diagram illustrating a gaming device, in accordance with the present invention.

FIG. 1 is a block diagram illustrating a gaming device 100, also termed a gaming machine, in accordance with the present invention. The gaming device 100 includes a main board 144 and a back plane 146 integrally or separately formed. Memory expansion board 140 as well as processor board 142 including a graphics system processor and video expansion board VGA/SVGA 148 are operably coupled to the main board 144. The main board 144 preferably includes memory in the form of ROM, RAM, flash memory and EEPROM (electrically erasable programmable read only memory). In addition, the main board 144 includes a system event controller, a random number generator (RNG), a win decoder/pay table, status indicators, a communications handler, and a display/sound generator.

The main board 144 is operably coupled to the back plane 146 which may include additional memory, such as in the form of an EEPROM, and connectors to connect to peripherals. Furthermore, the back plane 146 provides a plurality of communication ports for communicating with external peripherals. The back plane 146 provides the coupling between discrete inputs 150 and the processor board 142 and main board 144. Typical examples of elements that provide discrete inputs 152 are coin acceptors, game buttons, mechanical hand levers, key and door switches, and other auxiliary inputs. Furthermore, the back plane 146 provides the coupling between discrete outputs 152 and the processor board 142 and main board 144. Typically, elements that provide discrete outputs 152 are in the form of lamps, hard meters, hoppers, diverters and other auxiliary outputs.

The back plane 146 also provides connectors for at least one power supply 154 for supplying power for the processor board 142 and a parallel display interface 156 and a serial interface 158 for at least one game display device 178. In addition, the back plane 146 also provides connectors for a sound board 160 and a high-resolution monitor 162. Furthermore, the back plane 146 includes communication ports for operably coupling and communicating with an accounting interface 164, a touch screen 166 (which may also serve as a game display device), a bill validator 155 incorporated in a currency (bill) acceptor, a printer 168, an accounting network interface 170, a progressive current loop 172, and a network link 174. The accounting network interface 164, the touch screen 166, the printer 168, and the serial interface 158 preferably utilize an RS-232 interface. However, the use of other interfaces is also within the scope of this invention.

The back plane 146 optionally includes connectors for external video sources 180, expansion buses 182, game or other displays 184, an SCSI port 188, and an interface 190 for at least one card reader 192 (debit/credit, player card, etc.) and/or key pad 194. Optionally attached via the SCSI port 188 are disks, CD's, printers, etc. 186. The back plane 146 also preferably includes means for coupling a plurality of reel driver boards 196 (one per reel) which drive physical game reels 198 with a shaft encoder or other sensor means to the processor board 142 and main board 144. Of course, the reels may be similarly implemented electronically by display as video images, technology for such an approach being well known and widely employed in the art. In such an instance, reel driver boards 196 and physical game reels 198 with associated hardware are eliminated and the game outcome generated by the random number generator on main board 144 is directly displayed on a video game display 184 and, optionally, on a separate game device display 178, as known in the art. Other gaming machine configurations for play of different wagering games such as video poker games, video blackjack games, video Keno, video bingo or any other suitable primary games are equally well known in the art. It will also be understood and appreciated by those of ordinary skill in the art that selected components of gaming device 100 may be duplicated for play of a bonus game or event in accordance with the present invention, in that at least a separate board with a second random number generator may be employed, with associated peripherals and links thereto, for play of the bonus game. In a conventional situation wherein the bonus game of the present invention may be operably coupled as a "top box" or otherwise associated with a conventional, existing gaming machine configured for play of a primary or base game, many of the components illustrated in FIG. 1 and described with respect thereto may be duplicated, including separate software and associated memory for conducting play of the bonus game with associated pay tables for the bonus awards.

Figure 2:
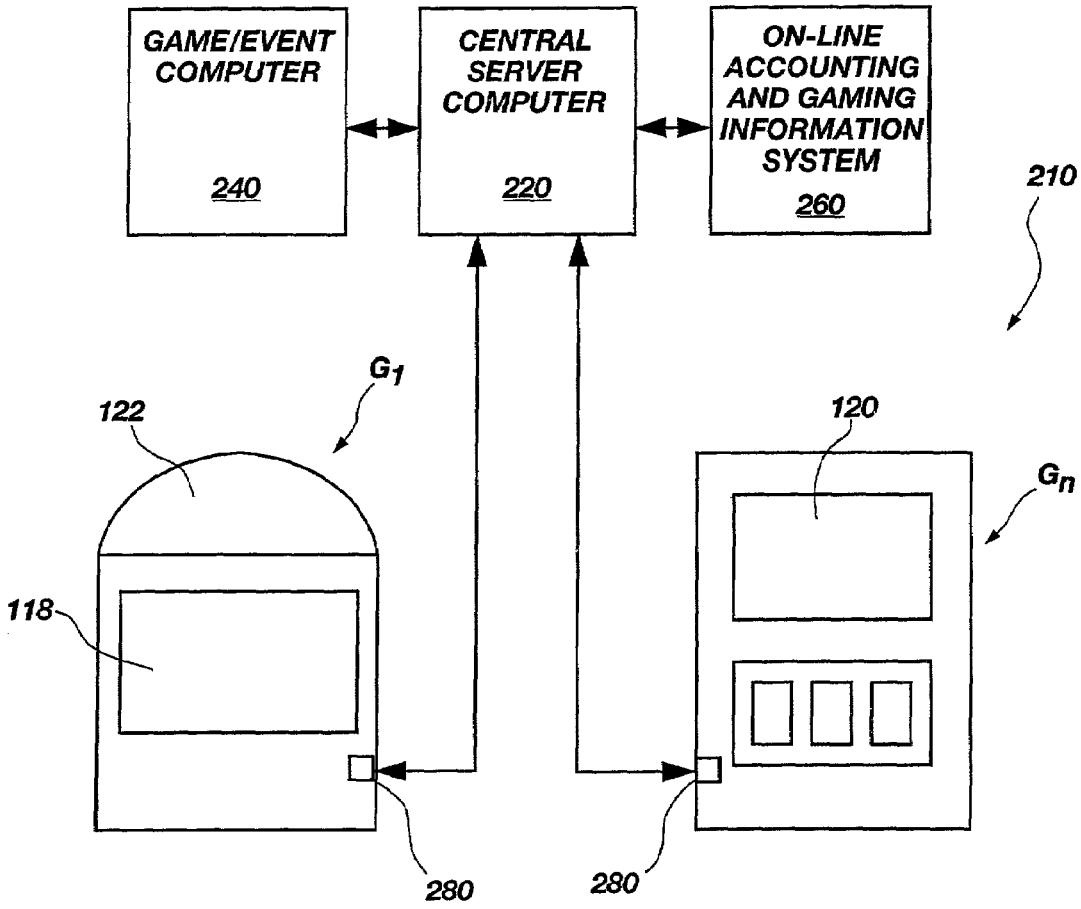
FIG. 2 is a block diagram illustrating a gaming network which may incorporate gaming machines as shown and described with respect to FIG. 1.

FIG. 2 is a block diagram illustrating a gaming network 210 utilizing gaming machines $G_1, G_2 \ldots G_n$ which may be configured as gaming machines 100 shown in FIG. 1. In implementation of the present invention, the gaming machines offering play of the bonus event of the present invention may be deployed, as schematically depicted in FIG. 2, in a gaming network 210 that includes a central server computer 220 operably coupled to a plurality of gaming machine $G_1, G_2 \ldots G_n$ which may include both electronic and reel-type game machines. It is notable that, unless the gaming network 210 is configured for progressive play, a variety of different makes of gaming machines $G_1, G_2 \ldots G_n$ offering widely different games may be incorporated in gaming network 210, since the bonus event operates independently of the primary game on each gaming machine $G_1, G_2 \ldots G_n$. Of course, in implementation of the present invention it is preferred that all of the gaming machines $G_1, G_2 \ldots G_n$, even if configured for play of different primary or base games, offer substantially the same opportunity to accrue advantages for bonus game play. The central server computer 220 automatically interacts with a plurality of gaming machines $G_1, G_2 \ldots G_n$ to activate an incoming call or outgoing call bonus event.

More specifically, and again referring to FIGS. 1 and 2, the gaming network 210 includes a central server computer 220, a bonus event computer 240 and a plurality of gaming machines $G_1, G_2 \ldots G_n$. Each gaming machine $G_1, G_2 \ldots G_n$ includes a controller assembly 280 operably coupled to the central server computer 220 and comprised of a controller unit designed to facilitate transmission of signals from each individual gaming machine $G_1, G_2 \ldots G_n$ to central server computer 220. In addition, the controller assembly 280 includes a network interface board fitted with appropriate electronics for each specific make and model of each individual gaming machine $G_1, G_2 \ldots G_n$.

Referring to FIG. 2, in electronic video games, the central server computer 220 is operably coupled to at least one video game display element 118 as shown at the left-hand side of FIG. 2 and sequesters a portion of the video game display element 118 for displaying video attract sequences to attract potential players. Video game display element 118 may be used for display of both the primary and bonus games. Where the gaming network 210 includes reel type gaming machines $G_1, G_2 \ldots G_n$, as shown at the right-hand side of FIG. 2, the central server computer 220 may be operably coupled to at least one active display element 120 so that potential players receive a clear indication of attract sequences and the active display element may be used as a video display for the bonus game. As shown at the left-hand side of FIG. 2, the gaming machines $G_1, G_2 \ldots G_n$ may also be provided with a second video display element 122 as an alternative to sequestering a portion of the video game display element 118 for displaying video attract sequences and the bonus game. In addition, the central server computer 220 may include sound-generating hardware and software for producing attractive sounds orchestrated with the video attract sequences at each of gaming machines $G_1, G_2 \ldots G_n$ if such is not already incorporated therein. The games support input and output between the player and the game for such devices as heads up display, joystick, keyboard, mouse and data glove via interface modules connected through the expansion bus or buses 182 and SCSI port 188.

The attractive multimedia video displays and dynamic sounds may be provided by the central server computer 220 by using multimedia extensions to allow gaming machines $G_1, G_2 \ldots G_n$ to display full-motion video animation with sound to attract players to the machines. During idle periods, the gaming machines $G_1, G_2 \ldots G_n$ preferably display a sequence of attraction messages in sight and sound. The videos may also be used to market specific areas of the casino and may be customized to any informational needs.

Furthermore, the gaming network 210 includes bonus event computer 240 operably coupled to the central server computer 220 for scheduling bonus parameters such as the type of bonus game, pay tables and players. Of course, the functions of central server computer 220 and bonus event computer 240 may be combined in a single computer. Preferably, the gaming network 210 further includes a real-time or on-line accounting and gaming information system 260 operably coupled to the central server computer 220. The accounting and gaming information system 260 includes a player database for storing player profiles, a player tracking module for tracking players and a pit, cage and credit system for providing automated casino transactions.

Figure 3:
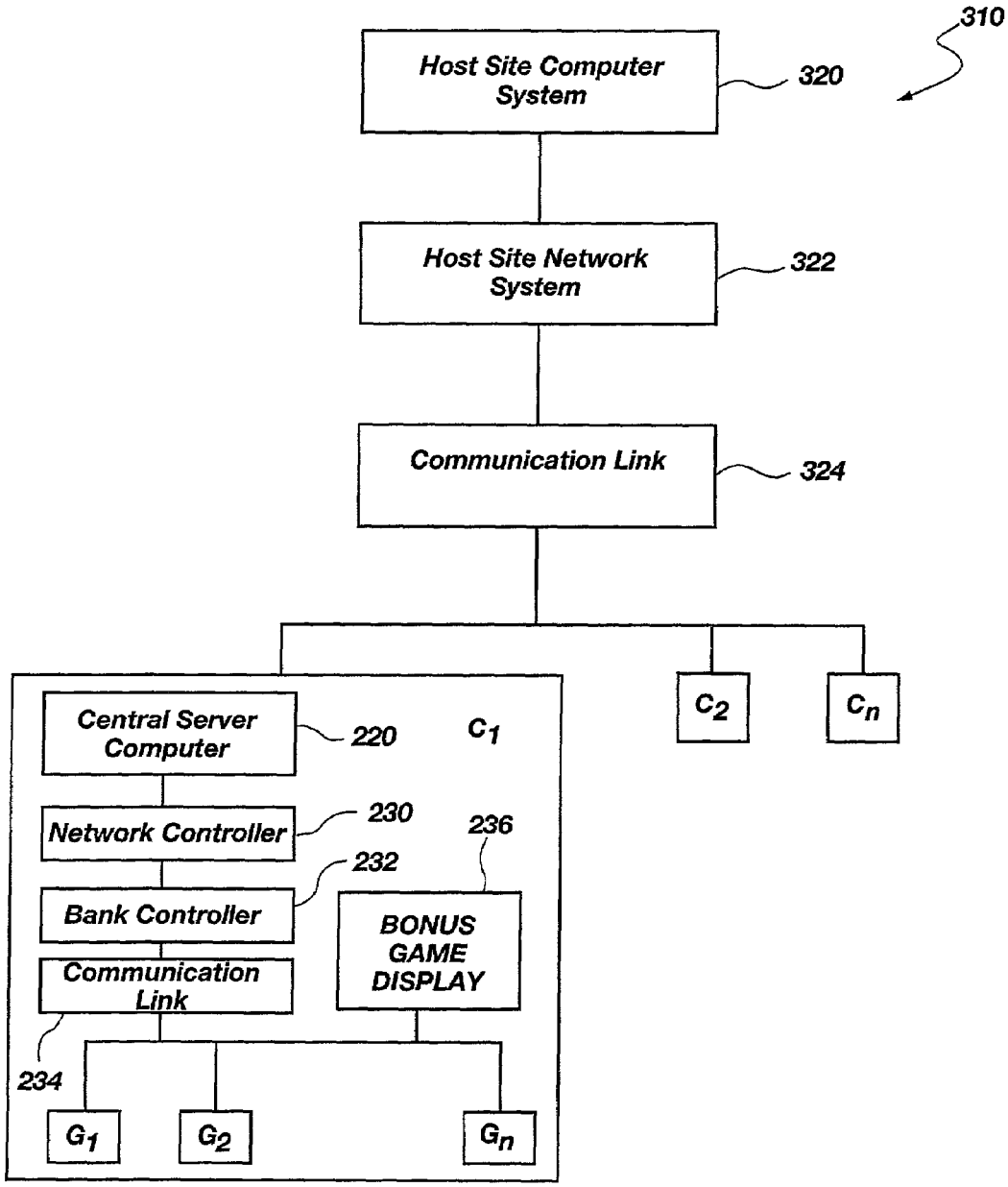
FIG. 3 is a block diagram illustrating a gaming system that includes the gaming network shown in FIG. 2.

FIG. 3 is a block diagram illustrating a bonus gaming system 310 that includes the gaming network 210 shown in FIG. 2. As previously implied, a bank of gaming machines $G_1, G_2 \ldots G_n$ may be networked together in a progressive configuration, as known in the art, wherein a portion of each wager to initiate a primary game may be allocated to bonus event awards. In addition, and referring to FIG. 3, a host site computer 320 is coupled to a plurality of the central server computers 220 at a variety of mutually remote casino sites or other gaming sites $C_1, C_2 \ldots C_n$ for providing a multi-site linked progressive automated bonus gaming system 310.

Preferably, the host site computer 320 will be maintained for the overall operation and control of the gaming system 310. The host site computer 320 is operably coupled to a host site computer network 322 and a communication link 324 provided with a high-speed, secure modem link for each individual casino site $C_1, C_2 \ldots C_n$.

Each casino site $C_1, C_2 \ldots C_n$ includes the central server computer 220 provided with a network controller 230 which includes a high-speed modem operably coupled thereto. Bidirectional communication between the host site computer 320 and each casino site central server 220 is accomplished by the set of modems transferring data over communication link 324.

A network controller 230, a bank controller 232 and a communication link 234 are interposed between each central server computer 220 and the plurality of attached gaming machines at each casino site $C_1, C_2 \ldots C_n$. In addition, the network controller 230, the bank controller 232 and the communication link 234 may optionally be interposed between each central server 220 and at least one separate bonus game display 236 at each casino site $C_1, C_2 \ldots C_n$. However, the gaming system 310 may include hardware and software to loop back data for in-machine meter displays to communicate with bonus event award insert areas on gaming machines $G_1, G_2 \ldots G_n$.

Bonus game display 236 may be particularly suitable for use when the bonus game is configured for play between two player opponents and may be configured as a relatively large, liquid crystal display ("LCD") screen or a plurality of such screens. The screen(s) is/are relatively large in comparison to the high resolution monitor 162 or other game display device 178 of gaming machine 100. The bonus game display(s) 236 may be positioned in an area above the gaming machines $G_1, G_2 \ldots G_n$ so that the screen(s) is/are visible to all players at a bank of gaming machines $G_1, G_2 \ldots G_n$. Bonus game display 236 may comprise other types of display screens known in the art including cathode ray tube (CRT) screens, plasma display screens, and/or screens based on light-emitting diode (LED) technology. Bonus game display 236 may be a display screen configured for multiple uses and/or concurrent display of other casino-sponsored information. For example, bonus game display 236 may be used in association with a Sports Book venue of the casino during periods in which bonus game display 236 is temporarily not used for the purposes of the present invention.

Gaming machines $G_1, G_2 \ldots G_n$ may be connected to bonus game display 236 through communication link 234. Communication link 234 may be any of a variety of communication links known in the art, including, but not limited to: twisted-pair wire, coaxial cable, fiber optic, Ethernet, token ring, bus line, Fibre Channel, ATM, standard serial connections, LAN, WAN, Intranet, Internet, radio waves, or other wireless connections.

It will be appreciated by those of ordinary skill in the art that another embodiment may employ some or all gaming machines $G_1, G_2 \ldots G_1$ in the form of personal computers located at sites remote from the host site computer 320. The personal computers may be located in homes, businesses or other locations remote from the host site computer 320, such as a casino site $C_1, C_2 \ldots C_n$. In this embodiment, the personal computers are configured such that the personal computer may connect to host site computer 320 through a network, such as the Internet. The personal computers are enabled to participate in gaming activities by downloading software, wherein the software provides access to the gaming activities and configures the personal computer for play of the gaming activity. The games are preferably conducted and controlled from the host site computer 320.

In the bonus game of the present invention, the player of the primary game at one of gaming machines $G_1, G_2 \ldots G_n$ qualifies for the bonus game by achieving a specific outcome or by meeting other selected criteria associated with play of the primary game.

In order to qualify for the bonus game, a special symbol or element may be provided on one or more reels of the gaming machine offering a primary game. These symbols are referred to as "event symbols." The player must achieve a predetermined number of event symbols, the specific outcome, to participate in the bonus game. In one preferred embodiment, the event symbol is a "Pong" symbol and the player must achieve two "Pong" symbols on a pay line to qualify for the bonus game. However, it will be readily apparent to one of ordinary skill in the art that the bonus game may be activated by other event symbols and that the number of event symbols necessary to activate the bonus game may vary, depending on how frequently the gaming establishment wants the bonus game activated.

Other ways to qualify for the bonus game may also be contemplated. For instance, players may qualify by achieving multiple specific outcomes in the primary game, playing the primary game a preselected number of times, playing the primary game multiple times for a preselected duration of time, or wagering a preselected sum over a plurality of plays of the primary game. It is possible that multiple players may simultaneously qualify for the bonus game. It is also possible for one player to win multiple qualifications into the bonus game.

Upon qualifying for the bonus game, the player is notified of his opportunity to participate by an interaction with his gaming machine 100, which is one of a bank or other plurality of gaming machines $G_1, G_2 \ldots G_n$. This interaction may occur through the appearance of a message on a high resolution monitor 162, touch screen 166 or other game display device 178 of gaming machine 100. Once activated, the bonus game may start immediately. However, in the event that the bonus game is played between player opponents, it may also start each time two players or a multiple of two players have qualified for the bonus game, at fixed or random time intervals (for example, the bonus game may be activated five minutes after conclusion of the last bonus game or every five minutes between players or between a player competing against a computer-generated "opponent" either by intent or because no other player has qualified for bonus game play), randomly throughout the day, when a predetermined number of primary games offered in a bank or other plurality of gaming machines $G_1, G_2 \ldots G_n$ have been played, or in response to a game outcome.

Figure 4:
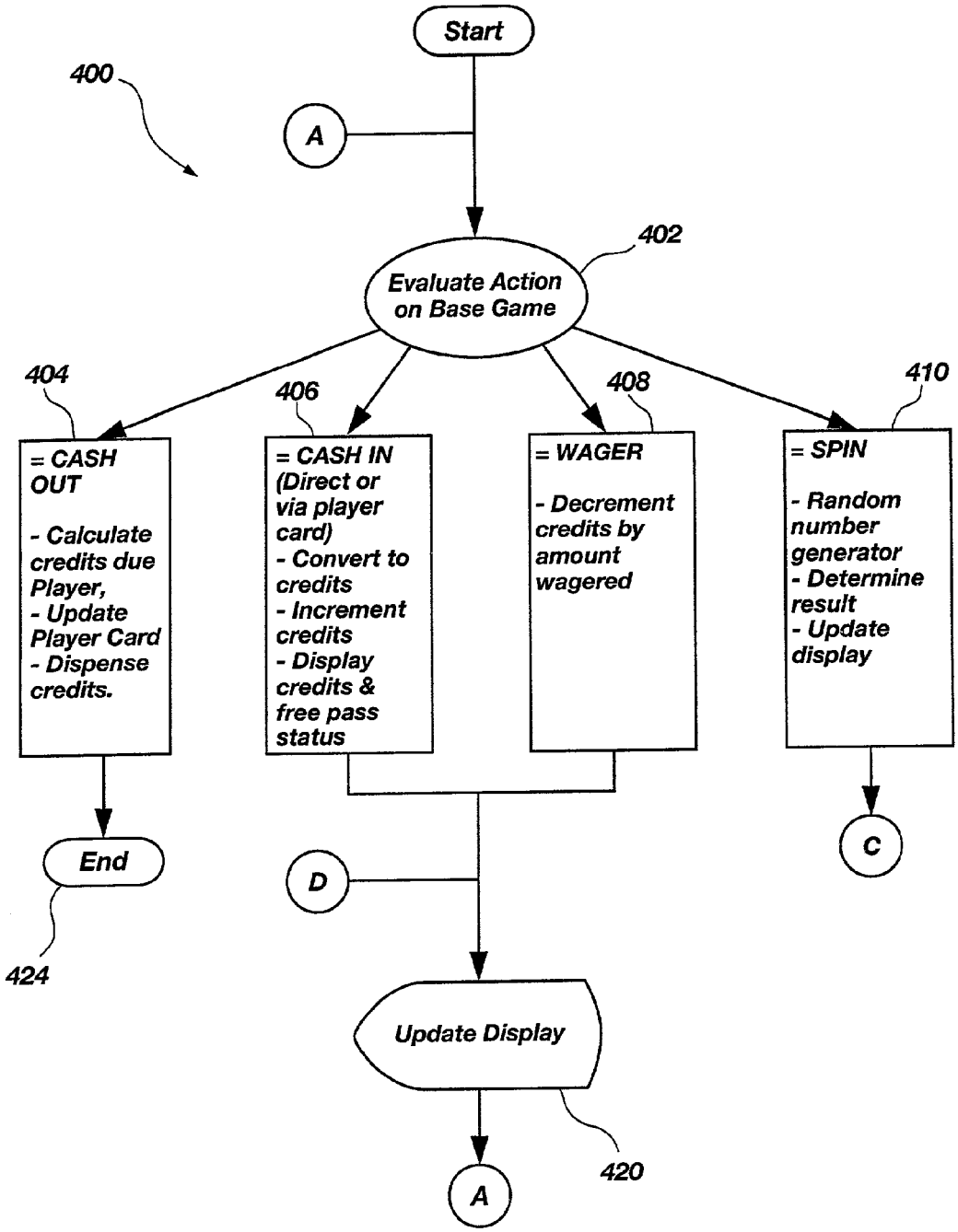
FIGS. 4 and 5 are flowcharts that together illustrate operation of an exemplary primary or base game, in accordance with an embodiment of the present invention.
Figure 5:
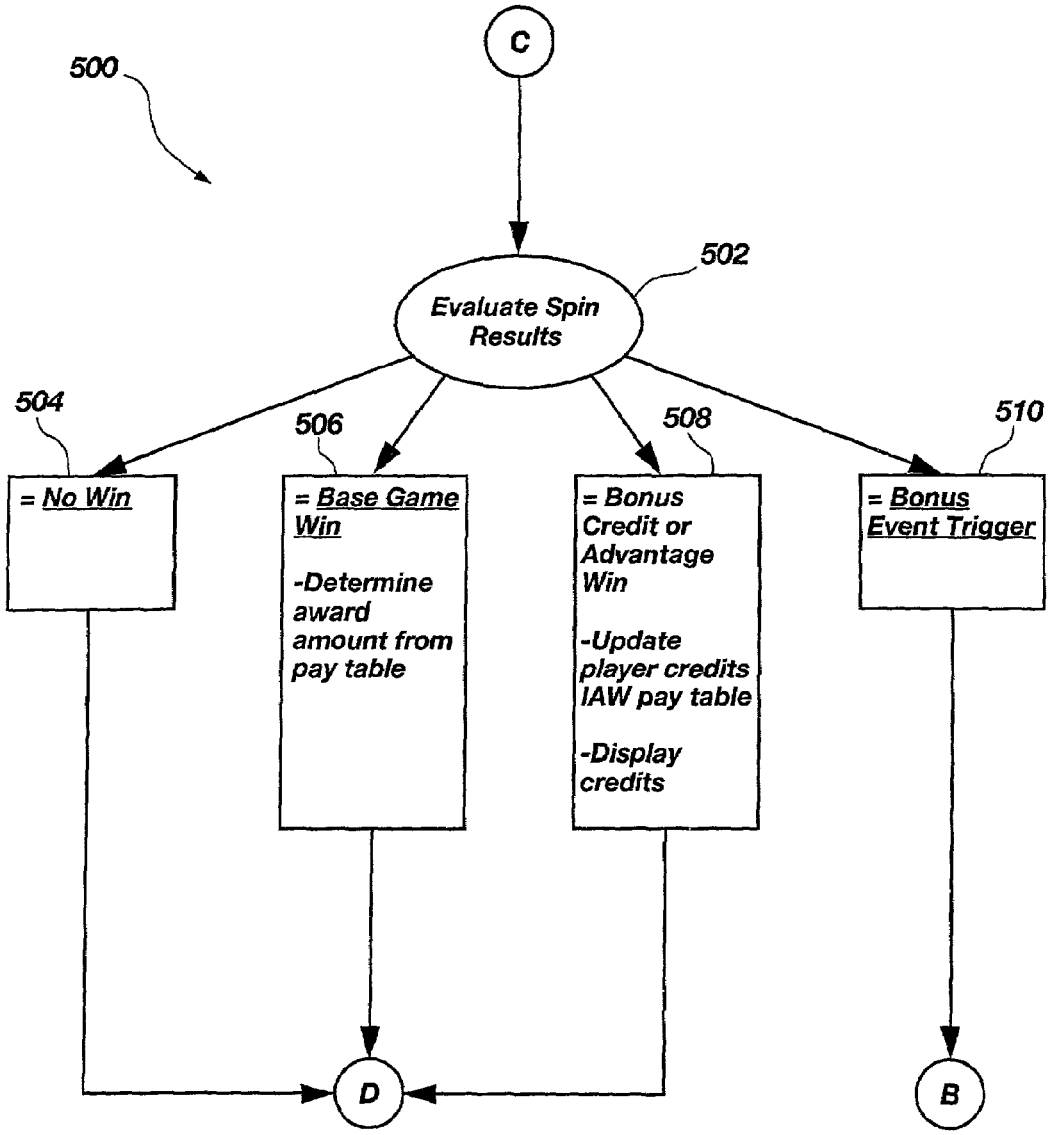

FIGS. 4 and 5 together illustrate an exemplary operating sequence 400, 500 of a primary or base game. In referring to FIGS. 1, 4 and 5, the player begins play on a gaming machine 100 comprising a reel-type primary or base game by first placing cash 406 into the machine via a coin acceptor, bill validator 155, or by credits read from his player card, credit card or debit card by card reader 192. He next determines the amount of wager for the first round of primary or base game play and enters that amount 408. Finally he spins the reels 410.

The gaming machine 100 will typically determine the outcome of each round of play of the primary or base game by means of a random number generator and then compare the result to a predetermined pay table and evaluate if a winning combination of symbols on a pay line or pay lines was achieved 502.

If a winning combination is not achieved 504, then the display is updated and the player is prompted for his next action 420. The player may cash out 404 and the credits due to him are calculated and dispensed to him and the information on his player card is updated, at which point play is ended 424. The player may also put additional cash into the gaming machine 406 or place a wager based on available credits 408, the amount of the wager causing a decrement of available credits in the wager amount. The foregoing alternatives may continue during play of a number of rounds of the primary or base game, wherein the player evaluates what action to take 402 based on the results of the prior round of play.

If a primary or base game winning combination is achieved 506, the player's credits are updated in accordance with the associated pay table value. If a bonus game advantage or credit winning combination is achieved, the player's credits are incremented in accordance with (IAW) a predetermined pay table and the display is updated to reflect the credits 508.

Another winning combination may be used as a bonus event trigger 510. The bonus event trigger is typically independent of the bonus game or advantage credit wins and other nonbonus event-related wins associated with play of the primary or base game. If the winning combination is not the bonus event trigger, then the player is prompted to continue play as described above 420. If the winning combination is a bonus event trigger, then the player's bonus credits are updated and the bonus event is initiated 602 (FIG. 6).

Figure 6:
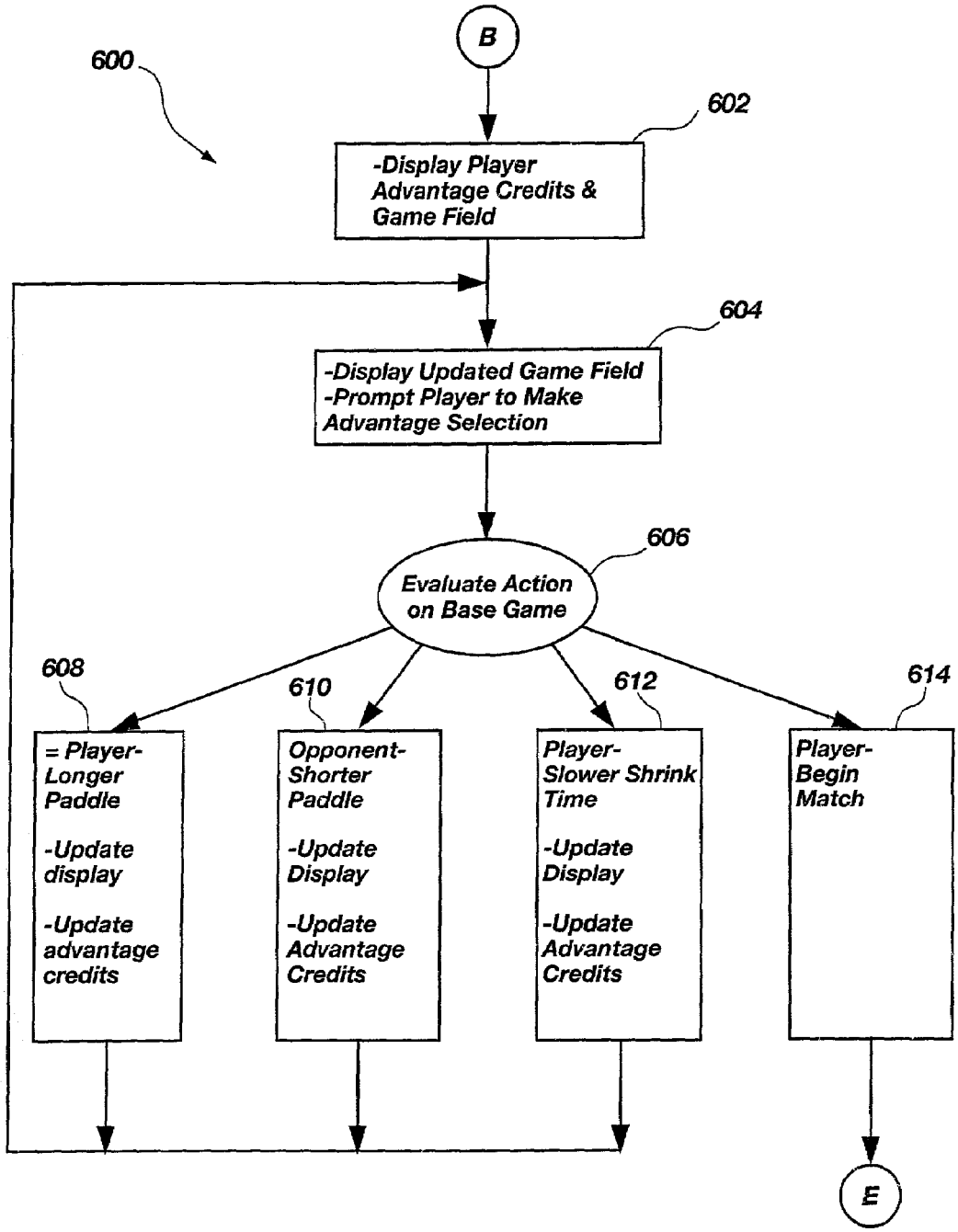
FIGS. 6 and 7 are flowcharts that together illustrate operation of an exemplary bonus game, in accordance with an embodiment of the present invention.
Figure 7:
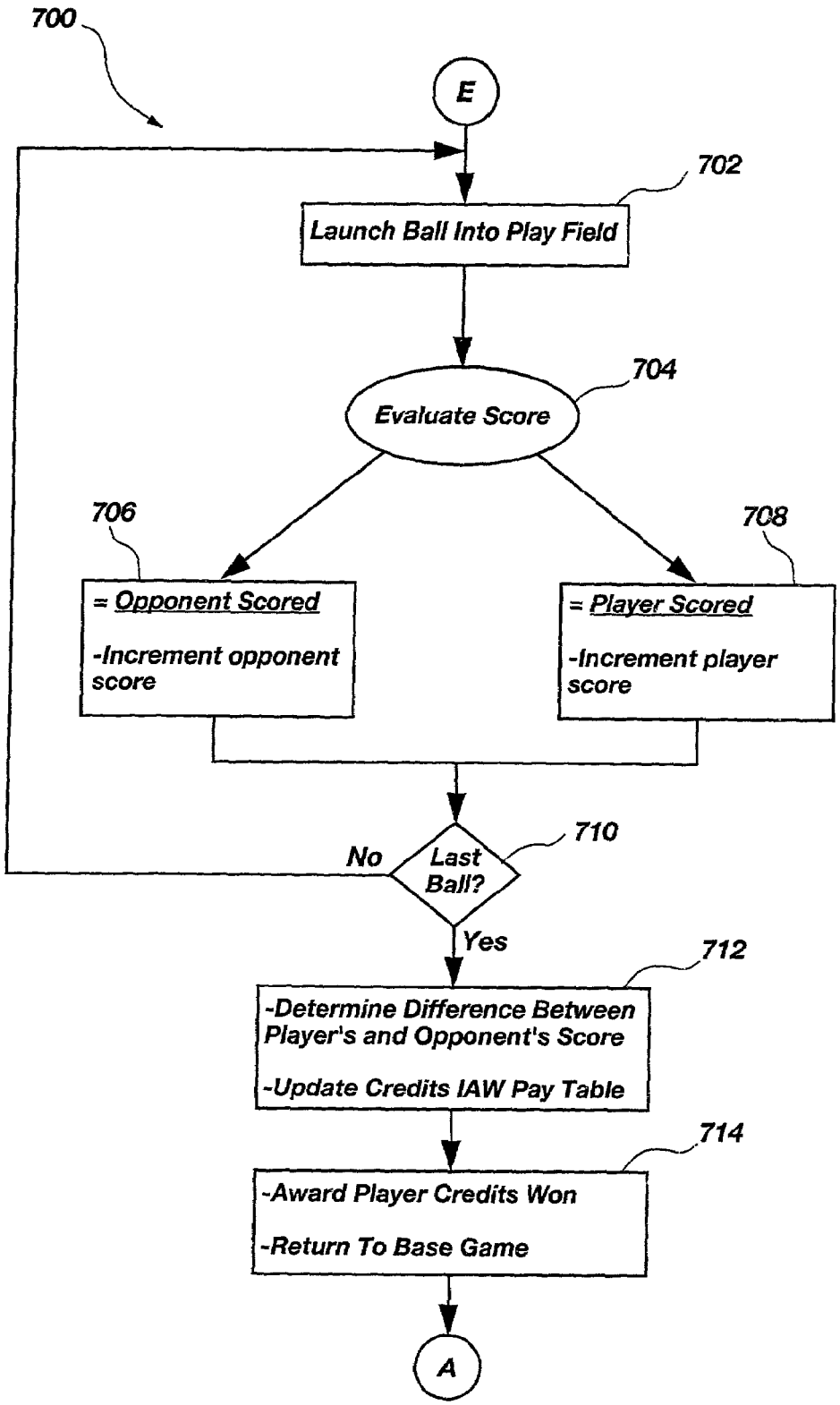

FIGS. 6 and 7 together illustrate an exemplary operation of a bonus event 600 initiated by a bonus event trigger 510. An objective of the player in the bonus event 600 is to score points against an opponent and to prevent the opponent from scoring points against the player. The highest score wins the match. The degree of difference between the player's score and the opponent's score may be used to determine the size of the bonus award in accordance with a predetermined pay table. The opponent may be either another player or a computer-generated opponent. The bonus game may be self-contained in a "top box" of a gaming machine for stand-alone play, or each gaming machine 100 may serve as a remote terminal for play of a bonus game administered on a bonus event computer 240 as part of a bank or other local network or, for example, a gaming system 310 encompassing multiple sites. The bonus awards may be configured as a function of the coin in for play of the primary game, and relative award amounts maintained in accordance with a pay table to afford a substantially constant overall return to the house.

The bonus event play starts by displaying a player's advantage credits and the bonus game display 800 (see FIG. 8) at 602. Then a first loop is entered. An updated game field is displayed and the player is prompted to make an advantage selection at 604. The response from the player is then evaluated 606. In using this advantage selection, depending on the architecture of the bonus game, the player may be enabled to make his paddle relatively longer 608 (see FIG. 10), make his opponent's paddle relatively shorter 610 (see FIG. 11), or provide a smaller shrink time for his paddle 612 (see FIG. 12) than for his opponent's. One, some or all of these options may be offered to the player. In all of these cases, the display is updated, and the player's advantage credits are updated to reflect his advantage purchases. The process then repeats, starting again with the display of an updated game field and prompting of the player to make another advantage selection 604. It is contemplated that a player may be restricted to selecting a single advantage for each of a plurality of rounds or tiers of bonus play, and that a predetermined threshold outcome from each round or tier of bonus play may be required to advance to the next, higher, round or tier with associated larger bonus awards.

When the player decides that he does not wish to purchase an additional advantage, actual bonus event play commences 614. A second loop 700 is entered and a ball is launched into the game field 702. The ball travels back and forth between the paddles of the player and his opponent until one of them scores. At that point, the score is evaluated 704. If the opponent scored, the opponent's score is incremented 706. Otherwise, if the player scored, his score is incremented 708. A test is then made to determine whether the last ball in the bonus event 710 has been launched. If this was not the last ball in the bonus event, then another ball is launched into the game field 702 and the preceding sequence repeats until all balls allocated to the bonus event have been launched 710.

When all of the balls in the bonus event have been launched 710 and the attendant play sequences completed, the player's score is compared with his opponent's score. The difference between the two scores determines the number of credits to be awarded to the player from a pay table 712. The credits are then awarded to the player 714 and play returns to the primary or base game. If play in the bonus game is between two actual players rather than between a player and a computer-generated opponent, the identity of mutual opponents may be hidden to avoid any potential for collusion between players to increase one player's bonus award by prevailing over the other by a large margin. Alternatively, a fixed difference in award for prevailing in a bonus match, regardless of the margin of victory, may be provided.

Play of the bonus game of the present invention is contemplated as predominantly involving random chance, wherein advantages purchased may or may not positively affect the outcome of a round of bonus play in a player's favor, but have the potential to do so. For example, in the Pong game described hereafter, different paddle lengths or the rate of paddle shrinkage may affect the bonus game outcome after a ball is launched, but only if the ball bounces in the right place at the right time and rebounds from a player's paddle or misses his opponent's paddle. Since bounces of the ball are random and each ball launch may be effected along a random trajectory, it will be appreciated that an "advantage" may constitute either a real, or a perceived but illusory, advantage in the course of a bonus game, random chance affecting even the use of an advantage.

Figure 8:
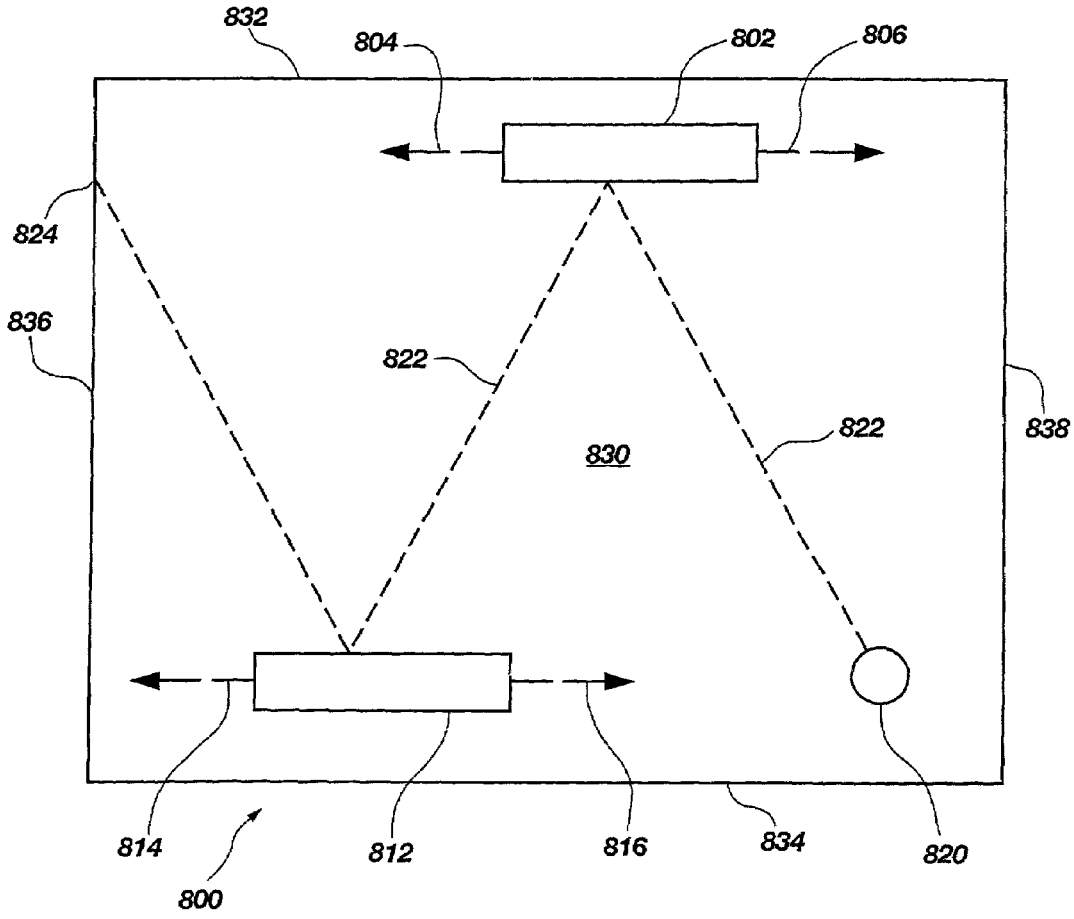
FIG. 8 is a block diagram that illustrates a display format and an exemplary play sequence of a Pong game.

FIG. 8 illustrates an exemplary Pong game as utilized as a bonus game in accordance with an embodiment of the present invention. By way of background, Pong was one of the first video games available. It was originally played utilizing a television as a display. It may best be understood as a simplified game of ping-pong between two opposing players. Pong is typically played on a game field 830 between two opponents. The game field 830 is rectangular, with four sides: a top 832, a bottom 834, a left side 836, and a right side 838. The left side 836 and the right side 838 act like solid barriers, reflecting the ball 820, while the top 832 and the bottom 834 act like goals.

Each of the two opposing players has a paddle 802, 812. In this illustration, the player's paddle 812 is shown on the bottom 834 of the game field 830 and his opponent's paddle 802 is shown on the top 832 of the game field 830. Both paddles 802, 812 are laterally movable back and forth, parallel to the top 832 and bottom 834 of the game field 830. The player's paddle 812 can move left 814 and right 816 from the left side 836 of the game field 830 to the right side 838. Similarly, his opponent's paddle 802 can move left 804 or right 806 from the left side 836 of the game field 830 to the right side 838. The closest wall to (behind) a paddle 802, 812, acts as a goal, and the purpose of the paddles 802, 812 is to prevent the ball 820 from striking the goal being defended to the rear of the respective paddle. Thus, the player moves his paddle 812 left 814 and right 816 to keep the ball 820 from striking the bottom 834, while his opponent moves its paddle 802 left 804 and right 806 to keep the ball 820 from striking the top 832.

In play, a ball 820 is launched 824 at 702 (FIG. 7) into the game field 830 at an angle which may be determined by a random number generator. From that point onward, the ball 820 bounces against the sides 836, 838 of the game field 830 and the paddles 802, 812 until the ball 820 gets hit by one of the paddles 802, 812 and hits the top 832 or the bottom 834. The owner of the paddle 802, 812 that missed the ball 820 then is considered to have lost that round of play, and another ball 820 is launched 824 at 702 into the game field 830. The ball 820 typically follows Newton's laws of motion exactly 822, with the angle of incidence of the ball's trajectory matching the angle of reflection whenever the ball 820 strikes a side 836, 838 of the game field 830 or one of the paddles 802, 812. Since the two paddles 802, 812 do not cover their respective top and bottom 832, 834 of the game field 830, it is necessary to move them left 804, 814 and right 806, 816 in order to keep the ball 820 in play. It is contemplated that back-and-forth movement of paddles 802, 812 may be regular and at a constant rate, may be randomized, may be player-controlled as to when movement direction is changed or as to rate of movement, or otherwise in accordance with the architecture of the bonus game.

Theoretically, it is possible to keep a ball 820 in play indefinitely. However, to speed play and in order to make the bonus game more challenging, the two paddles 802, 812 may be caused to shrink during game play. As they shrink, it becomes ever harder to prevent the ball 820 from striking the top 832 or the bottom 834 of the game field 830, thus allowing one opponent or the other to score in a relatively shorter time period than with fixed-length paddles 802, 812.

Figure 9:
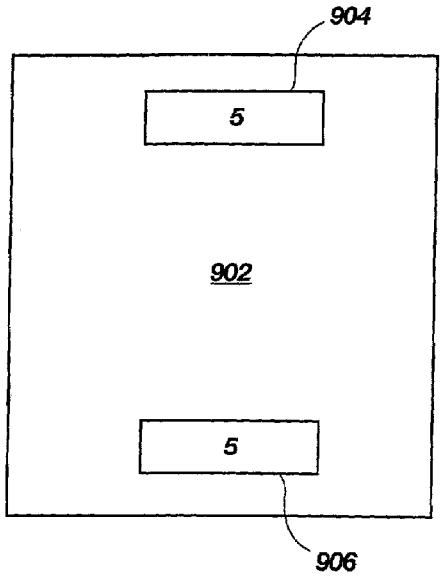
FIGS. 9, 10, 11, and 12 are block diagrams that illustrate exemplary advantage selections during bonus game play, in accordance with an embodiment of the present invention.
Figure 10:
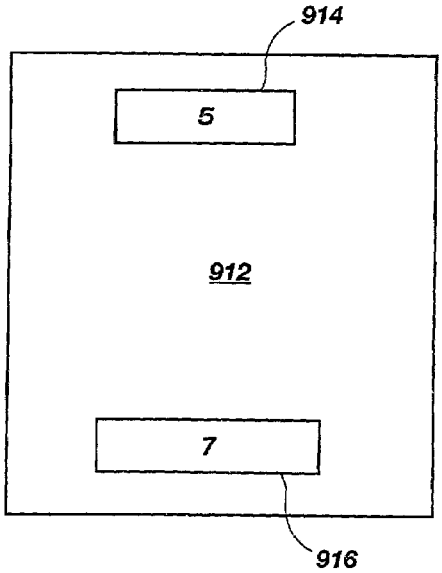
Figure 11:
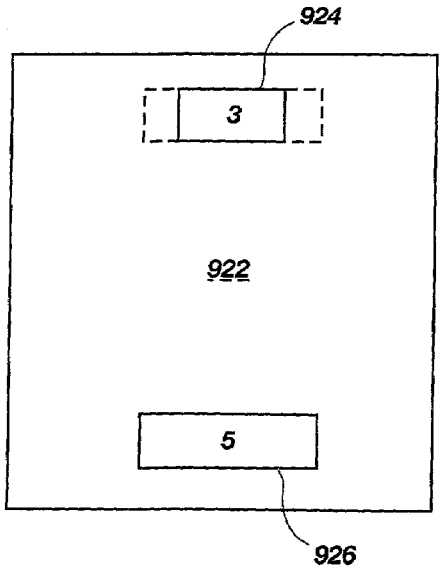
Figure 12:
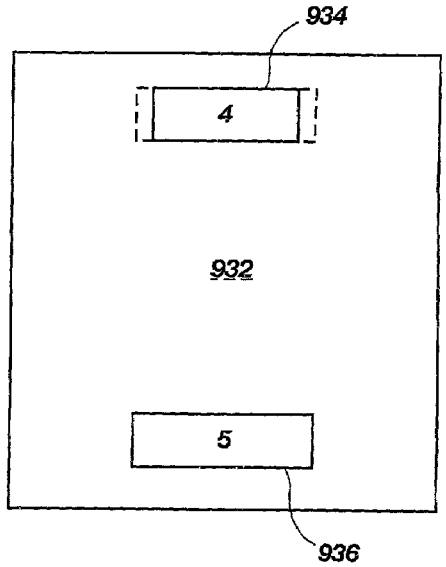

Returning to FIGS. 6 and 7, the player and the opponent begin the bonus game with equal advantages relative to the length of their respective paddles and the rate at which each paddle shrinks over the period of the game (FIG. 9). The player may use his advantage credits in three different ways. He may use them to lengthen his own paddle 812 thereby making it harder for the opponent to get a shot past him (FIG. 10). He may shorten his opponent's paddle 802 so that it will be easier for him to score a shot against his opponent (FIG. 11). Finally, he may slow the rate of shrinkage of his paddle, the faster shrinking of his opponent's paddle making it easier for him to score points later in the game (FIG. 12).

At the beginning of the bonus event, the player is displayed his options regarding available advantage credits and the game field at 602. The game field 830 is displayed to the player. The numbers respectively within the player's paddle 812 and the opponent's paddle 802 are representative of units of length of each paddle. In these examples, the length of each paddle is shown initially as "5" units. The player is then prompted to make an advantage selection 604. The player's selections are evaluated 606.

FIGS. 9, 10, 11, and 12 further illustrate this aspect of the bonus game play. FIG. 9 illustrates exemplary bonus event play with both opponents having equal sized paddles 904, 906 on the game field display 902. This is the situation when the player has not made an advantage selection. Each of the paddles 904, 906 shown has an initial value of 5 units indicating their initial equal size or length. Without an advantage selection, both paddles 904, 906 will shrink during game play at the same rate, until one opponent or the other loses the round when a ball 820 passes a paddle 802, 812 and scores a goal.

The player may decide to lengthen his paddle in relationship to the opponent's paddle at 608 as shown in FIG. 10. If he decides to use an advantage credit to effect this change, the game field display 912 is updated to reflect the increase of the player's paddle 916 length, in relationship to the opponent's paddle 914 length. In this example, the player's paddle 916 length is increased to 7 units and the opponent's paddle 914 length remains at 5 units.

The player may decide to shorten the opponent's paddle in relationship to his paddle at 610 as shown in FIG. 11. If he decides to use an advantage credit to effect this change, the game field display 922 is updated to reflect the decrease of the opponent's paddle 924 length in relationship to the player's paddle 926 length. In this example, the opponent's paddle 924 length is decreased to 3 units and the player's paddle 926 length remains at 5 units.

Over the period of the match play during the bonus game, the player's paddle and the opponent's paddle each shrink in size at the same rate. A third option for the player is to decide to slow the shrinkage rate of his paddle in relation to the shrinkage rate of the opponent's paddle at 612 as shown in FIG. 12. If he decides to use an advantage credit to effect this change, the game field display 932 is updated to reflect the slower rate of shrinkage of the player's paddle 936 length in relationship to the opponent's paddle 934 length. In this example, the opponent's paddle 934 length is decreased to 4 units and the player's paddle 936 length remains at 5 units over the same time period.

In the foregoing drawing figures, an exemplary Pong game is shown with the player utilizing a paddle 812 that moves right 816 and left 814 across the bottom 834 of the game field 830 and his opponent utilizing a paddle 802 that moves right 806 and left 804 across the top 832 of the game field 830. This arrangement is, of course, only illustrative. Any rotation, change in relative dimensions of length and width or transformation of the game field 830 is also within the scope of this invention. For example, the player's paddle and that of his opponent may be reversed in position.

The present invention is disclosed with respect to an exemplary bonus game of Pong wherein a player may play a Pong match against another player opponent or a computer-generated opponent. It will be appreciated that the bonus game may be implemented as a standalone bonus game on an individual gaming machine, or played over a network of gaming machines, with the bonus game administered by a bonus event computer. The network may be used to enable play between two players at networked gaming machines. The award format for the bonus game may comprise fixed or predetermined awards, comprise a progressive, or comprise a combination of the foregoing, as known in the art.

Of course, the use of an advantage element in other types of games is also within the scope of this invention. For example, a bonus game may be implemented in the form of a basketball game wherein the player may elect to lower the hoop, have longer legs, shrink the ball when he is shooting, enlarge the hoop when he is shooting, etc. Similarly, with a hockey game, the size of an opponent's goal may be caused to grow during a match or the size of a player's goal to shrink, or the opposing goaltender's stick to shrink during a match or a player's stick to enlarge. Thus, the player may utilize an advantage selection to initially reduce the size of his own goal, initially increase the size of his opponent's goal, initially increase the size of his goal tender's stick, initially decrease the size of his opponent's goal tender's stick, or reduce the rate at which his goal grows or his goaltender's stick shrinks.

In other implementations of the present invention, competitions may be configured as races. For example, in a Grand Prix- or NASCAR®-type auto race, a player may buy advantages in the form of additional power, tires for special conditions such as rain, a bigger fuel tank to lessen frequency of pit stops, a better pole position or similar disadvantages for an opponent, particularly a computer-generated opponent. In such a racing embodiment, it is contemplated that more than two players may participate, as in real auto racing. In another race embodiment, the player may enter a ski race and purchase longer skis, better wax, fewer gates to traverse, etc. In still another horse race embodiment (also suitable for participation by more than two players), a player may purchase a lighter jockey, better pole position, a mount with a more powerful finish, etc.

In yet other implementations of a bonus game according to the present invention, the bonus game may be configured in a format other than competition against another player (real or computer). For example, the bonus game may be configured as a rodeo event in the form of bronco riding, wherein a player may purchase a better glove for his saddle hand, longer legs to grip the bronco, extra seconds toward the elapsed riding time required for a win, etc. The bonus game may be configured so that the player is a rock climber scaling a cliff, wherein the climber may purchase better climbing shoes, extra pitons to drive into the rock face, ledges on which to rest, voids and vugs in the rock face to enable better finger and toe holds, etc.

While the exemplary embodiments disclose using at least one gaming machine G located at one casino or other gaming site, it is possible for remote players of the primary game to qualify for the bonus game of the present invention using the gaming system 310 previously described. For instance, these remote players may play the primary game on networked gaming machines at mutually remote sites within a casino, at a plurality of mutually remote casino sites, or at virtual gaming sites such as personal computers or other devices serving as terminals. As is known in the art, software to play the primary game may be downloaded onto a personal computer.

Upon qualifying for the bonus game, which may occur in a manner similar to qualification on a gaming machine G located at the casino site, the player may be provided with an opportunity to wager on the bonus game. It is contemplated that the software downloaded to the personal computer may include the bonus game of the present invention or sufficient communication capability to interact in substantially real time with a host server. The existence and further development of broadband communication links including DSL, cable, and even broadband wireless may enable remote play from a variety of locations using diverse hardware such as hand-held wireless terminals at a casino, personal digital assistants (PDAs), etc. Further, the bonus game may be posted on an Internet site associated with the casino or other sponsor of the bonus game. The bonus game is accessible to the player if the specific outcomes are achieved in the primary game. The player may participate in the bonus game through his personal computer terminal via the Internet, such as through streaming audio or video.

As shown in FIG. 3, and previously described, system 310 includes a host site computer 320 operably coupled to multiple central server computers 220, which may be located at a variety of mutually remote casino or other gaming sites $C_1$, $C_2$ . . . $C_n$. Alternatively, central server computers 220 may be used to interface with a plurality of personal computers, PDAs, or other terminals. Preferably, the host site computer 320 will be maintained for the overall operation and control of the competitive bonus gaming system 310. Each physical or virtual gaming site, represented as $C_1$, $C_2$ . . . $C_n$ in FIG. 3, includes the network controller 230, the bank controller 232, and the communication link 234 interposed between each central server computer 220 and the multiple gaming machines schematically illustrated as $G_1$, $G_2$ . . . $G_n$. As alluded to above, gaming machines $G_1$, $G_2$ . . . $G_n$ may comprise conventional gaming machines 100, personal computers, wired or wireless terminals, PDAs, or a combination thereof. Thus, the term "gaming machine" is used herein in its broadest sense and encompasses any device used as a terminal by at least one player to participate in the bonus game.

A video game has been disclosed that allows a player to improve the odds of his success in a bonus game by winning an advantage outcome in a primary or base game. A player may win advantage credits in association with play of the primary or base game. He may then utilize the advantage credits to provide himself with an advantage when playing the bonus game. This provides the player with an enhanced game playing experience by using strategy.

Moreover, having thus described the invention, it will be apparent that numerous modifications and adaptations may be resorted to without departing from the scope and fair meaning of the instant invention as set forth above and as described by the claims.

Those of ordinary skill in the art will recognize that modifications and variations may be made without departing from the spirit of the invention. Therefore, it is intended that this invention encompass all such variations and modifications as fall within the scope of the appended claims.

What is claimed is:

1. A method of providing a bonus game comprising:

receiving a selection of a first advantage from a player; and providing the first advantage for a first play of the bonus game by the player, the bonus game being a game of Pong, the first advantage comprising at least one of an initial shortening of a paddle of an opponent, an initial lengthening of a paddle of the player, a slower shrinkage of a paddle of the player than a paddle of an opponent, or a slowing of a rate of shortening of the paddle of the player during the play of the bonus game where a paddle of the player shortens during a play of the bonus game.

2. The method in claim 1 which further comprises prompting the player to effect the selection of the first advantage.

3. The method in claim 1 which further comprises displaying a plurality of advantage choices for selection of the first advantage by the player.

4. The method in claim 3 which further comprises displaying a total of available advantage credits to the player.

5. The method in claim 1 which further comprises:

receiving a selection of a second advantage from the player; and providing the second advantage for the first play of the bonus game by the player.

6. The method in claim 1 which further comprises requiring the player to pay for the first advantage.

7. The method in claim 6 wherein requiring the player to pay comprises requiring payment in the form of credits earned in association with play of an associated primary game.

8. The method in claim 6 wherein requiring the player to pay comprises requiring the player to tender money.

9. The method in claim 1 which further comprises determining whether the player won a predetermined outcome from the first play of the bonus game.

10. The method in claim 9 which further comprises:

if the player was determined to have won the predetermined outcome from the first play of the bonus game then;

receiving a selection of a second advantage from the player; and providing the second advantage for a second play of the bonus game by the player.

11. The method in claim 1 wherein a player is enabled to select a second advantage from the advantages in claim 1.

12. A method of providing a bonus game comprising:

receiving a selection of a first advantage from a player; and providing the first advantage for a first play of the bonus game by the player, the bonus game being a game of basketball, the first advantage comprising at least one of a longer set of legs for a basketball player representing a player, a shorter basket height, or a smaller ball or a larger hoop for a basketball player representing a player.

13. A method of providing a bonus game comprising:

receiving a selection of a first advantage from a player; and providing the first advantage for a first play of the bonus game by the player, the bonus game being a game of hockey, the first advantage comprising at least one of an initially longer stick for a player, a shorter stick for an opponent, a smaller goal for a player, or a larger goal for an opponent.

14. An apparatus for providing a bonus game comprising:

a gaming device including:

a memory containing computer instructions for:

receiving a selection of a first advantage from a player through an input device; and providing the first advantage for a first play of the bonus game by the player, the bonus game being a game of Pong, the first advantage comprising at least one of an initial lengthening of a paddle of the player, an initial shortening of a paddle of an opponent, or a slowing of the shortening of the paddle of the player during the play of the bonus game where a paddle of the player shortens during a play of the bonus game.

15. The apparatus in claim 14 which further comprises:

a display device configured for prompting the player for the selection of the first advantage.

16. The apparatus in claim 14 which further comprises:

a display device configured for displaying a plurality of choices for the selection of the first advantage by the player.

17. The apparatus in claim 16 wherein the display device is further configured for:

displaying a total of advantage credits accrued in association with play of a primary game to the player for use by the player in purchasing the first advantage.

18. The apparatus in claim 14 wherein the memory further contains computer instructions for providing a second advantage for the first play of the bonus game by the player.

19. The apparatus in claim 14 wherein the memory further contains computer instructions for requiring the player to pay for the first advantage.

20. The apparatus in claim 19 wherein the computer instructions for requiring the player to pay further comprise requiring the player to utilize credits acquired in association with play of a primary game.

21. The apparatus in claim 19 wherein the computer instructions for requiring the player to pay further comprise requiring the player to utilize money.

22. The apparatus in claim 14 wherein the memory further contains computer instructions for determining whether the player achieved a predetermined first outcome during the first play of the bonus game.

23. The apparatus in claim 22 wherein:

the apparatus is configured for receiving a selection of a second advantage from the player through the input device if the player was determined to have achieved the predetermined first outcome; and the memory further contains computer instructions for:

providing the second advantage for a second play of the bonus game by the player if the player was determined to have achieved the predetermined first outcome.

24. An apparatus for providing a bonus game comprising:

a gaming device including:

a memory containing computer instructions for:

receiving a selection of a first advantage from a player through an input device; and providing the first advantage for a first play of the bonus game by the player, the bonus game being a game of basketball, the first advantage comprising at least one of a longer set of legs for a basketball player representing a player, a shorter basket, a smaller ball or a larger hoop.

25. An apparatus for providing a bonus game comprising:

a gaming device including:

a memory containing computer instructions for:

receiving a selection of a first advantage from a player through an input device; and providing the first advantage for a first play of the bonus game by the player, the bonus game being a game of hockey, the first advantage comprising at least one of a longer stick for a player, a shorter stick for an opponent, or a smaller goal for a player.

26. The apparatus in claim 14 wherein the bonus game is administered remotely by a bonus event computer.

* * * * *